US007294030B2

(12) United States Patent
Yazaki et al.

(10) Patent No.: US 7,294,030 B2
(45) Date of Patent: Nov. 13, 2007

(54) OUTBOARD MOTOR HAVING SEAL STRUCTURE FOR EXHAUST RELEASE PIPE

(75) Inventors: Makoto Yazaki, Wako (JP); Shinichi Ide, Wako (JP); Mitsuaki Kubota, Wako (JP); Hiroshi Yamamoto, Wako (JP)

(73) Assignee: Honda Motor Co., Ltd. (JP)

( * ) Notice: Subject to any disclaimer, the term of this patent is extended or adjusted under 35 U.S.C. 154(b) by 98 days.

(21) Appl. No.: 11/203,351

(22) Filed: Aug. 12, 2005

(65) Prior Publication Data

US 2006/0183386 A1 Aug. 17, 2006

Related U.S. Application Data

(62) Division of application No. 10/839,412, filed on May 5, 2004, now Pat. No. 6,941,921.

(30) Foreign Application Priority Data

May 13, 2003 (JP) ..... 2003-135049

(51) Int. Cl.
*B63H 21/00* (2006.01)
*F02M 25/00* (2006.01)

(52) U.S. Cl. ..... 440/89 R; 123/198 E

(58) Field of Classification Search ..... 440/89 R, 440/89 C, 89 G
See application file for complete search history.

(56) References Cited

U.S. PATENT DOCUMENTS 4,955,838 A * 9/1990 Wenstadt ..... 440/89 R
5,378,180 A * 1/1995 Nakayama et al. ..... 440/89 R
5,494,467 A * 2/1996 Sohgawa et al. ..... 440/89 R
6,283,809 B1 * 9/2001 Takase et al. ..... 440/89 R

* cited by examiner

*Primary Examiner*—Jesús D Sotelo
(74) *Attorney, Agent, or Firm*—Adams & Wilks

(57) ABSTRACT

An outboard motor includes an elastic seal lid attached to an under cover to form a hermetic seal between the under cover and an exhaust release pipe while closing an opening of the under cover from which an outlet portion of the exhaust release pipe projects outwardly. The seal lid includes a tubular seal portion projecting from at least one surface of a plate-like body of the seal lid. The tubular seal portion has annular seal lips fitted around an outer circumferential surface of the exhaust release pipe. The tubular seal portion is elastically deformable relative to the lid body to thereby take up or absorb an offset between the exhaust release pipe and the opening of the under cover produced due to cumulative manufacturing and assembling tolerances of relevant parts of the outboard motor.

5 Claims, 11 Drawing Sheets

OUTBOARD MOTOR HAVING SEAL STRUCTURE FOR EXHAUST RELEASE PIPE

CROSS REFERENCE TO RELATED APPLICATION

The present application is a division of prior U.S. application Ser. No. 10/839,412, filed on May 5, 2004, now U.S. Pat. No. 6,941,921 which is hereby incorporated by reference, and priority thereto for common subject matter is hereby claimed.

FIELD OF THE INVENTION

The present invention relates generally to outboard motors of the type having an exhaust release pipe provided for releasing engine exhaust gas to the atmosphere when exhaust pressure of an engine is low, and more particularly to an outboard motor having a seal structure for such exhaust release pipe.

BACKGROUND OF THE INVENTION

Outboard motors equipped with an exhaust release pipe (auxiliary exhaust pipe) of the type described are known as disclosed, for example, in Japanese Patent Laid-open Publication (JP-A) No. 9-039890.

The disclosed outboard motor has an engine room defined by an engine cover, and an exhaust expansion chamber defined by a driveshaft housing disposed below the engine cover. The engine room and the exhaust expansion chamber are separated or isolated from one another by an engine holder on which an engine is supported with an oil-seal housing disposed between the engine and the engine holder. A duct assembly having an inverted U-shaped configuration is mounted on the engine holder and extends vertically across the engine holder so that one end of the duct assembly opens to the exhaust expansion chamber for allowing entry of the engine exhaust gas and the other end of the duct assembly extends deeper from the exhaust expansion chamber for allowing entry of the water. The U-shaped duct assembly defines an exhaust discharge passage. The engine holder has an exhaust release passage formed therein. The exhaust release passage is connected at one end to the exhaust discharge passage and opens at the other end to the atmosphere outside the outboard motor.

During operation of the outboard motor, when the discharge pressure of the engine is high, exhaust gas discharged from the engine is converged into the exhaust expansion chamber, flows upward and then downward along the exhaust discharge passage defined by the inverted U-shaped duct assembly, and is finally discharged into the water. When the engine stops running or when the engine is idling, the exhaust pressure of the engine is low and the engine exhaust gas cannot be discharged into the water. Under such condition, the exhaust gas is released from exhaust expansion chamber to the atmosphere outside the outboard motor through the exhaust release passage.

In the disclosed outboard motor, the engine holder has a tubular portion forming an outlet part of the exhaust release passage and projecting outward from a circular opening formed in a rear end wall of the engine cover. A ring-shaped elastic seal member or packing is fitted in the circular opening of the engine cover so as to form a hermetic seal between the tubular engine holder portion and the engine cover.

The conventional outboard motor of the foregoing construction has a problem that due to cumulative tolerances involved in the manufacture and assembly of the engine cover and the engine holder, the tubular portion of the engine holder and the circular opening of the engine cover tend to become off-centered or eccentric with each other. Due to the eccentricity or offset between the tubular engine holder portion and the engine cover's circular opening, the elastic ring-shaped packing is distorted into a partly compressed and partly stretched configuration (that is, the ring-shaped packing is radially compressed at one side and radially stretched at another side diametrically opposite to the one side). The packing thus distorted cannot provide a uniform contact pressure between itself and the engine cover and also between itself and the tubular engine holder portion, failing to form a reliable seal between the tubular engine holder portion and the engine cover. Especially when the offset between the tubular engine holder portion and the engine cover's circular opening is large, the packing may be compressed and stretched beyond its elasticity. In such instance, a compressed side of the packing may cause fatigue, and a stretched side of the packing may separate from the tubular engine holder portion or the engine cover, allowing entry of the water into the outboard motor.

Attempts to reduce the offset between the tubular engine holder portion and the engine cover's circular opening may require precision working, which is time-consuming, lowers the assembling efficiency and increase the cost of the outboard motor.

SUMMARY OF THE INVENTION

It is, therefore, an objective of the present invention to provide an outboard motor having a seal structure for an exhaust release pipe, which is capable of achieving a reliable sealing performance even when the offset between the exhaust release pipe and an opening in a cover member is relatively large.

According to the present invention, there is provided an outboard motor comprising: an engine; a mount case on which the engine is mounted; a cover structure that covers the engine; an exhaust release pipe for releasing at least part of an exhaust gas from the engine into the air outside the outboard motor, the exhaust release pipe having an outlet portion projecting outward from an opening formed in the cover structure; and elastic seal means for creating a hermetic seal between the cover structure and the exhaust release pipe while closing the opening of the cover structure. The elastic seal means has a retaining portion engaged with the cover structure or the exhaust release pipe to retain the seal means on the cover structure or the exhaust release pipe, a first seal portion being in sealing contact with the cover structure, a second seal portion being in sealing contact with the exhaust release pipe, and an offset absorbing portion disposed between the retaining portion and the first or the second seal portion and elastically deformable to absorb an offset between the exhaust release pipe and the opening of the cover structure without affecting the hermetic seal created between the cover structure and the exhaust release pipe.

By virtue of the offset absorbing portion, the seal means is capable of achieving a reliable sealing performance even when the offset between the exhaust release pipe and the opening of the cover structure is relatively large.

Preferably, the retaining portion of the seal means is generally disposed in a plane of the cover structure including the opening, and the offset absorbing portion is disposed interiorly or exteriorly of the cover structure with respect to the plane of the cover structure including the opening. The first seal portion of the seal means may be generally disposed in the plane of the cover structure including the opening.

The cover structure defines an engine room in which the engine is installed, and the opening in the cover structure opens to the engine room. The outboard motor may further include an exhaust expansion chamber defined below the mount case for temporarily receiving therein the exhaust gas from the engine in which instance the exhaust release pipe is connected to the exhaust expansion chamber at an end opposite to the outlet portion thereof.

In one preferred form of the invention, the elastic seal means comprises a seal lid formed from an elastic material and including a plate-like lid body attached to the cover structure so as to close the opening, and a tubular seal portion formed integrally with the plate-like lid body and projecting from at least one surface of the plate-like lid body. The second seal portion of the seal means comprises at least one annular seal lip formed on an inner circumferential surface of the tubular seal portion and having an inside diameter smaller than an outside diameter of the outlet portion of the exhaust release pipe. The tubular seal portion is elastically bendable about a proximal end thereof relative to the plate-like lid body and thus forms the offset absorbing portion of the seal means. The seal lip is preferably inclined toward an outlet end of the exhaust release pipe. This arrangement is particularly advantageous when the seal lid is subjected to an engine intake pressure (negative pressure) developed inside the engine room.

Preferably, the seal lid further includes one or more annular retaining lugs formed on the inner circumferential surface of the tubular seal portion for elastically supporting the outlet portion of the exhaust release pipe. The annular retaining lugs have an inside diameter smaller than the outside diameter of the outlet portion of the exhaust release pipe and larger than the inside diameter of the annular seal lip. The annular seal lip is preferably disposed between the annular pertaining lugs. One of the annular retaining lugs is located at a fore end of the tubular seal portion and has a beveled front end face for facilitating smooth entry of the outlet portion of the exhaust release pipe into the tubular seal portion.

The tubular seal portion may also project from an opposite surface of the plate-like lid body so as to form a rear part of the tubular seal portion. A lower half of the rear part is preferably sloped downward relative to an axis of the tubular seal portion so that the rear part has a vertically elongated oblong shape. The downwardly sloped rear part of the tubular seal portion will promote draining of the water from the tubular seal portion.

The retaining portion of the seal means may comprise a plurality of anchoring pins inserted through respective attachment holes in the lid body and corresponding mounting holes in the cover structure and anchored on the cover structure. The retaining portion may further include a plurality of locking projections formed integrally with the plate-like lid body of the seal lid and held in interlocking engagement with second mounting holes formed in the cover structure.

The first seal portion of the seal means may comprise an elastic seal block formed on the one surface of the plate-like lid body and being in sealing engagement with at least part of a peripheral edge of the opening of the cover structure. Preferably, the cover structure has a lid-mounting seat having substantially the same size and configuration as the plate-like lid body of the seal lid, and the first seal portion of the seal means comprises a first seal lip formed on the one surface of the lid body continuously along a peripheral edge of the lid-body for sealing engagement with a peripheral edge of the lid-mounting seat, and a second seal lip of a continuous loop-shape formed on the one surface of the lid body and disposed inwardly of the first seal lip for sealing contact with a front surface of the lid-mounting seat, the second seal lip extending to surround the opening of the cover structure. The seal lips in their free state are inclined toward a radial outward direction of the lid body so that when the lid body is in abutment with a front surface of the lid-mounting seat, the first seal lip lies flat on an outer surface of the cover structure with a tip end thereof directed outward of the lid-body, and the second seal lip lies flat on the front surface of the lid-mounting seat with a tip end thereof directed outward of the lid body. With the seal lips thus provided, the seal lid has a double seal structure, which is highly resistant against the entry of water into the outboard motor.

In another preferred form of the present invention, the elastic seal means comprises a seal member formed from an elastic material into a generally double tube structure having an inner tube fitted around the outlet portion of the exhaust release pipe and an outer tube retained on the cover structure. The inner tube and the outer tube are joined together at one end and extend at an angle relative to each other. A joint portion between the inner and outer tubes forms the offset absorbing portion of the seal means.

With this arrangement, when the outlet portion of the exhaust release pipe is offset (or off-centered) from the center of the opening due to cumulative tolerances involved in the manufacture and assembling of these and related parts of the outboard motor, the inner and outer tubes can move toward and way from each other about the joint portion to thereby take up or absorb the offset between the exhaust release pipe and the opening of the cover structure. The offset absorbing portion formed by the joint portion between the inner and outer tubes may be disposed exteriorly of the cover structure.

The retaining portion of the seal means may comprise a circumferential groove formed at an opposite end of the outer tube and firmly fitted with a peripheral edge of the opening of the cover structure. Furthermore, the second seal portion of the seal means may comprise at least one annular seal lip formed on an inner circumferential surface of the inner tube and having an inside diameter smaller than an outside diameter of the outlet portion of the exhaust release pipe. The seal lip is preferably inclined toward an outlet end of the exhaust release pipe. The seal member may further comprise an annular retaining lug formed on the inner circumferential surface of the inner tube for elastically supporting the outlet portion of the exhaust release pipe. The annular retaining lug has an inside diameter smaller than the outside diameter of the outlet portion of the exhaust release pipe and larger than the inside diameter of the annular seal lip.

BRIEF DESCRIPTION OF THE DRAWINGS

A preferred structural embodiment of the present invention will be described in detail hereinbelow, by way of example only, with reference to the accompanying drawings, in which.

DETAILED DESCRIPTION OF THE PREFERRED EMBODIMENT

Figure 1:
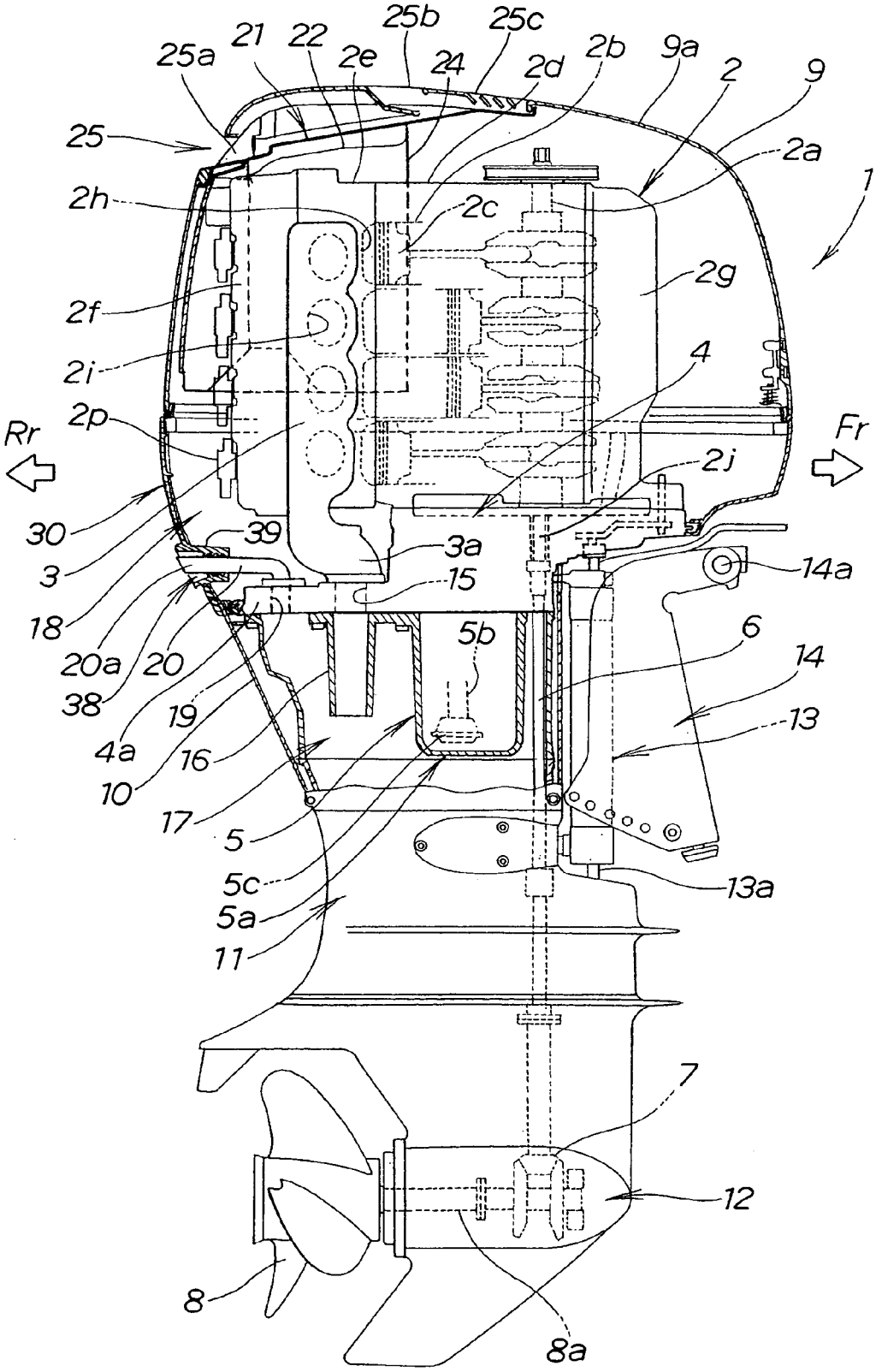
FIG. 1 is a schematic side view, with parts in cross section, of an outboard motor embodying the present invention.

Referring now to the drawings and FIG. 1 in particular, there is shown an outboard engine or motor 1 according to a preferred embodiment of the present invention. The outboard motor 1 generally comprises an engine 2, a case means or structure 4, 5, 13 and 14 for supporting the engine 2 and related parts thereof, and a cover means or structure 9, 10 defining an engine room 18 in which the engine 2 is installed. Throughout the specification, the terms "front" and "rear" are used with reference to the direction of movement of a boat on which the outboard motor 1 is mounted. Similarly, throughout the several views, reference characters "Fr" and "Rr" each associated with a profiled arrow are used to indicate "a forward direction" and "a rearward direction", respectively, when viewed from the direction of movement of the boat.

The engine 2 is a vertical multicylinder engine with a crankshaft 2*a* disposed vertically. The engine 2 in the illustrated embodiment has four cylinders 2*b* arranged in vertical juxtaposition and disposed horizontally so that the axis of each cylinder 2*b* extends along a longitudinal centerline of the outboard motor 1 in a substantially central region of the outboard motor 1. A piston 2*c* is slidably received in each cylinder 2*b*. The cylinders 2*b* are formed in a cylinder block 2*d*. The cylinder block 2*d* forms a central portion of the engine 2 when viewed in the front-and-rear direction (longitudinal direction) of the outboard motor 1. The engine 2 also has a cylinder head 2*e* disposed on a rear side (left-hand side in FIG. 1) of the cylinder block 2*d*, a cylinder head cover 2*f* disposed on a rear side of the cylinder head 2*e*, and a crankcase 2*g* disposed on a front side (right-hand side in FIG. 1) of the cylinder block 2*d*.

Each cylinder 2*b*, the piston 2*c* received in the cylinder 2*b* and the cylinder head 2*e* together form a combustion chamber 2*h*. The combustion chamber communicates with a corresponding one of four exhaust ports 2*i* formed in the cylinder head 2*e*. An exhaust manifold 3 is directly fixed to the cylinder head 2*e* over the exhaust ports 2*i*.

The engine 2 has a pump body (not shown) at a lower part thereof. The engine 2 as a whole is supported by a mount case 4 with the pump body disposed between an engine body and the pump body. An oil case 5 is mounted to the underside of the mount case 4 and extends in a vertical downward direction. The oil case 5 has a downwardly elongated oil pan 5*a* and a downwardly extending exhaust tube 16 disposed adjacent the oil pan 5*a*. A suction tube 5*b* extending downward from the non-illustrated pump body is received in the oil pan 5*a* with an oil strainer 5*c* connected to a lower end thereof. The oil strainer 5*c* is located near the bottom of the oil pan 5*a*.

The vertically disposed crankshaft 2*a* of the engine 2 is offset from the center of the outboard motor 1 toward the front side of the outboard motor 1. The crankshaft 2*a* has a lower end portion connected via a flywheel (not shown) to an output shaft 2*j*. The output shaft 2*j* extends vertically through the pump body and the mount case 4 and is connected to an upper end of a vertically disposed drive shaft 6. The drive shaft 6 extends downward through a vertical space defined between the oil pan 5*a* and a front portion of a peripheral wall (not designated) of the oil case 5. A lower end of the drive shaft 6 is connected via a transmission mechanism 7 to a front end (right end in FIG. 1) of a horizontally disposed output shaft 8*a*. A rear end of the output shaft 8*a* is connected to a screw-propeller 8. With this arrangement, engine power is transmitted from the crankshaft 2*a* of the engine 2 through the output shaft 2*j*, drive shaft 6, transmission mechanism 7 and output shaft 8*a* to the screwpropeller 8.

The cover structure 9, 10 is constructed to surround and cover the engine 2. More specifically, the cover structure 9, 10 includes a generally cap-shaped top cover 9 open downward and defining an upper part of the engine room 18, and a generally tubular-shaped under cover 10 defining a lower part of the engine room 18. Thus, the top cover 9 covers an upper part of the engine 2, while the under cover 10 covers a lower part of the engine 2. The under cover 10 is constructed not only to define the lower part of the engine room 18 but also to surround the mount case 4 and oil case 5 both disposed below the engine 2. The top cover 9 is also called "engine cover". The engine cover 9 and the under cover 10 are both molded of synthetic resin.

The engine room 18 is located at an upper end portion of the outboard motor 1. The mount case 4 forms a bottom wall of the engine room 18. The oil case 5 is mounted to the underside of the mount case 4. An extension case 11 is connected to a lower end of the oil case 5 and extends downward. The mount case 4, oil case 5 and extension case 11 together form an exhaust expansion chamber 17. The mount case 4 also forms a top wall of the exhaust expansion chamber 17. Thus, the mount case 4 vertically separates or isolates the engine room 18 formed above the mount case 4 and the exhaust expansion chamber 17 formed below the mount case 4. A gear case 12 is connected to a lower end of the extension case 11 and houses therein the transmission mechanism 7, a lower end portion of the drive shaft 6 and the output shaft 8*a*. The gear case 12 is made of metal such as aluminum alloys. The under cover 10 has a lower part extending downward to the extent that at least a joint portion between the oil case 5 and the extension case 11 is covered by the lower part of the under cover 10.

The outboard motor 1 further has a vertical swivel shaft 13*a* disposed exteriorly of a front end portion of the under cover 10 and extending between a front end portion of the mount case 4 and the extension case 11, and a horizontal tilt shaft 14*a* provided at an upper end portion of a stern bracket 14. The stern bracket 14 has a lower portion connected to a swivel case 13. The swivel case 13 covers the swivel shaft 13*a* and is connected to the mount case 4 and the extension case 11. The outboard motor 1 is mounted to the stern of a boat (not shown) via the stern bracket 14 so that the outboard motor 1 is movable to swing or turn left and right about the vertical swivel shaft 13*a* and also movable to tilt or turn up and down about the horizontal tilt shaft 14*a*. The mount case 4, oil case 5, extension case 11, and gear case 12 together form the case means or structure. The mount case 4 and peripheral parts thereof are made of metal such as aluminum alloys.

The exhaust tube 16 has an upper end connected to an outlet 3*a* of the exhaust manifold 3 via a vertical connecting hole 15 formed in the mount case 4. A lower end of the exhaust tube 16 opens to the exhaust expansion chamber 17. With this arrangement, engine exhaust gas discharged from the combustion chamber 2*h* is guided downward successively through the exhaust manifold 3, connecting hole 15 and exhaust tube 16*a* and converges into the exhaust expansion chamber 17.

The mount case 4 has a vertical through-hole 19 formed in a rear end portion 4*a* thereof. The through-hole 19 connects the engine room 18 and the exhaust expansion chamber 17. An L-shaped exhaust release pipe 20 is essentially disposed in the engine room 18. One end (front end) of the exhaust release pipe 20 is connected to the through-hole 19 formed in the mount case 4. An opposite end (rear end) 20*a* of the exhaust release pipe 20 projects outside the engine room 18 through an opening 50 (FIG. 2) formed in a rear end portion of the under cover 10.

During operation of the outboard motor 1, when exhaust pressure of the engine 2 is high, the exhaust gas discharged from the engine 2 is collected by the exhaust manifold 3, flows downward through the connecting hole 15 and the exhaust tube 16, converges into the exhaust expansion chamber 17, further passes downward through the expansion case 11 and is finally discharged into the water. However, when the engine 2 stops running or when the engine 2 is idling, exhaust pressure of the engine 2 is low and the exhaust gas cannot be discharged into the water. Under such condition, the discharge gas converged in the exhaust expansion chamber 17 is released or discharged from the exhaust release pipe 20 to the atmosphere outside the outboard motor 1.

In the illustrated embodiment, the exhaust release pipe 20 is connected to the vertical through-hole 19 formed in the mount case 4. The exhaust release pipe 20 may be connected to the oil pan 5 in place of the mount case 4, in which instance the rear end portion of the oil pan 5 is extended rearward to form a flange and a vertical through-hole is formed in the flange for connection with one end of the exhaust release pipe 20.

The outboard motor 1 also has an inverted U-shaped air intake duct 21 disposed astride a rear portion of the engine 2 including the cylinder head 2*e* and head cover 2*f*. The air intake duct 21 has a recessed top wall 22 and a pair of vertical sidewalls 24 of hollow structure (only one being shown) extending downward from opposite side edges of the recessed top wall 22. The engine cover 9 has a plurality of air inlets 25 formed in a top wall 9*a* thereof. The air inlets 25 include a first air inlet 25*a* in the shape of a horizontal slit extending from a rear end of the top wall 9*a* toward the front end of the engine cover 9, a second air inlet 25*b* located on a forward side (right-hand side in FIG. 1) of the first air inlet 25*a* and open upward, and a third air inlet 25*c* located on a forward side of the second air inlet 25*b* and provided with louvers. The outside fresh air is introduced from the air inlets 25*a*-25*c* into the engine room 18 through the air intake duct 21.

Figure 2:
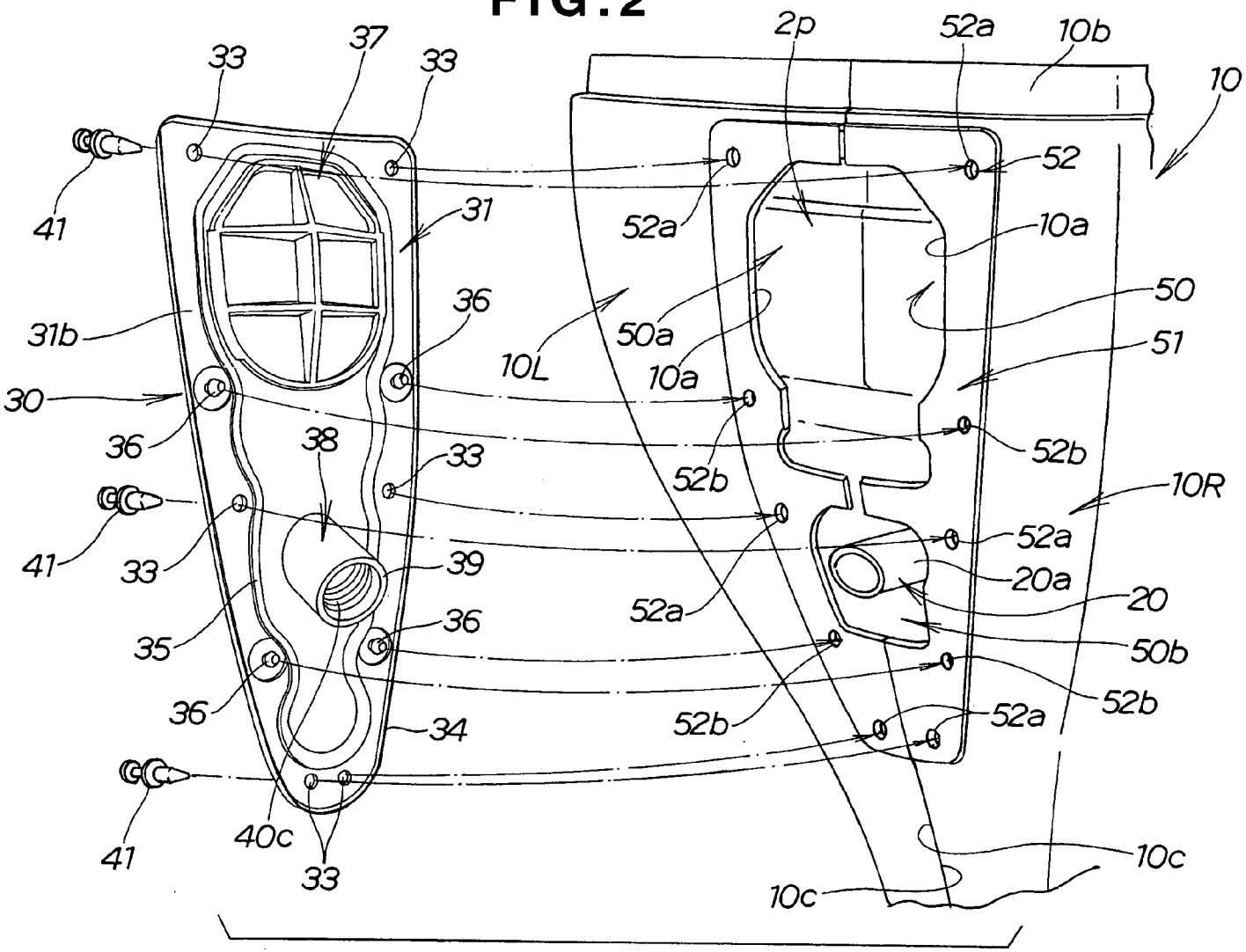
FIG. 2 is an explode perspective view showing a rear portion of the outboard motor with a seal lid detached from an under cover.

As shown in FIG. 2, the under cover 10 comprises a pair of right and left cover halves or members 10R, 10L joined together at front and rear ends thereof (only the rear end being shown) along a vertical plane. The right and left cover members 10R, 10L each have an elongate cutout recess 10*a* formed in a respective vertical edge 10*c* along an upper portion thereof. The cutout recesses 10*a*, 10*a* are symmetrical in shape with each other and, when the right and left cover members 10R, 10L are joined together along the vertical edges 10*c*, 10*c*, the cutout recesses 10*a*, 10*a* jointly form a vertically elongated, generally 8-shaped opening 50. Each of the cover members 10R, 10L has an upper edge formed with a vertical guide flange 10*b* for fitting engagement with a lower edge of the engine cover 9 (FIG. 1) when the engine cover 9 and the under cover 10 are assembled together.

The generally 8-shaped opening 50 has an upper opening 50*a* and a lower opening 50*b* connected together by a narrow channel (not designated). The upper opening 50*a* is larger in size than the lower opening 50*b*. The upper opening 50*a* corresponds in position to an ignition plug 2*p* of the lowermost cylinder 2*b* (FIG. 1) of the engine 2 and allows access of a tool to the ignition plug 2*p*. The lower opening 50*b* corresponds in position to the rear end portion (outlet portion) 20*a* of the exhaust release pipe 20. The outlet portion 20*a* of the exhaust release pipe 20 projects outwardly from the lower opening 50*b*. The under cover 10 has a flat lid-mounting land or seat 51 extending around the periphery of the opening 50. The lid-mounting seat 51 has a generally vertically elongated rectangular shape with its width reducing progressively in a downward direction. The lid-mounting seat 51 has a plurality (ten in the illustrated embodiment) of mounting holes 52 (52*a*, 52*b*) formed at intervals along a peripheral edge thereof. The mounting holes 52 include first mounting holes 52*a* (six in number) and second mounting holes 52*b* (four in number) having a smaller diameter than the first mounting holes 52*a*. Four out of six first mounting holes 52*a* are located near respective corners of the rectangular lid-mounting seat 51, and two other first mounting holes 52*b* are each disposed between a respective pair of vertically spaced first mounting holes 52*a*. The second mounting holes 52*b* are each disposed between two vertically adjacent ones of the first mounting holes 52*a*.

The opening 50 of the under cover 10 is completely closed by a seal means or lid 30. The seal lid 30 is formed from an elastic material such as rubber or soft synthetic resin. The seal lid 30 has a plate-like body 31 which is substantially the same in size and configuration as the lid-mounting seat 51 of the under cover 10.

Figure 3:
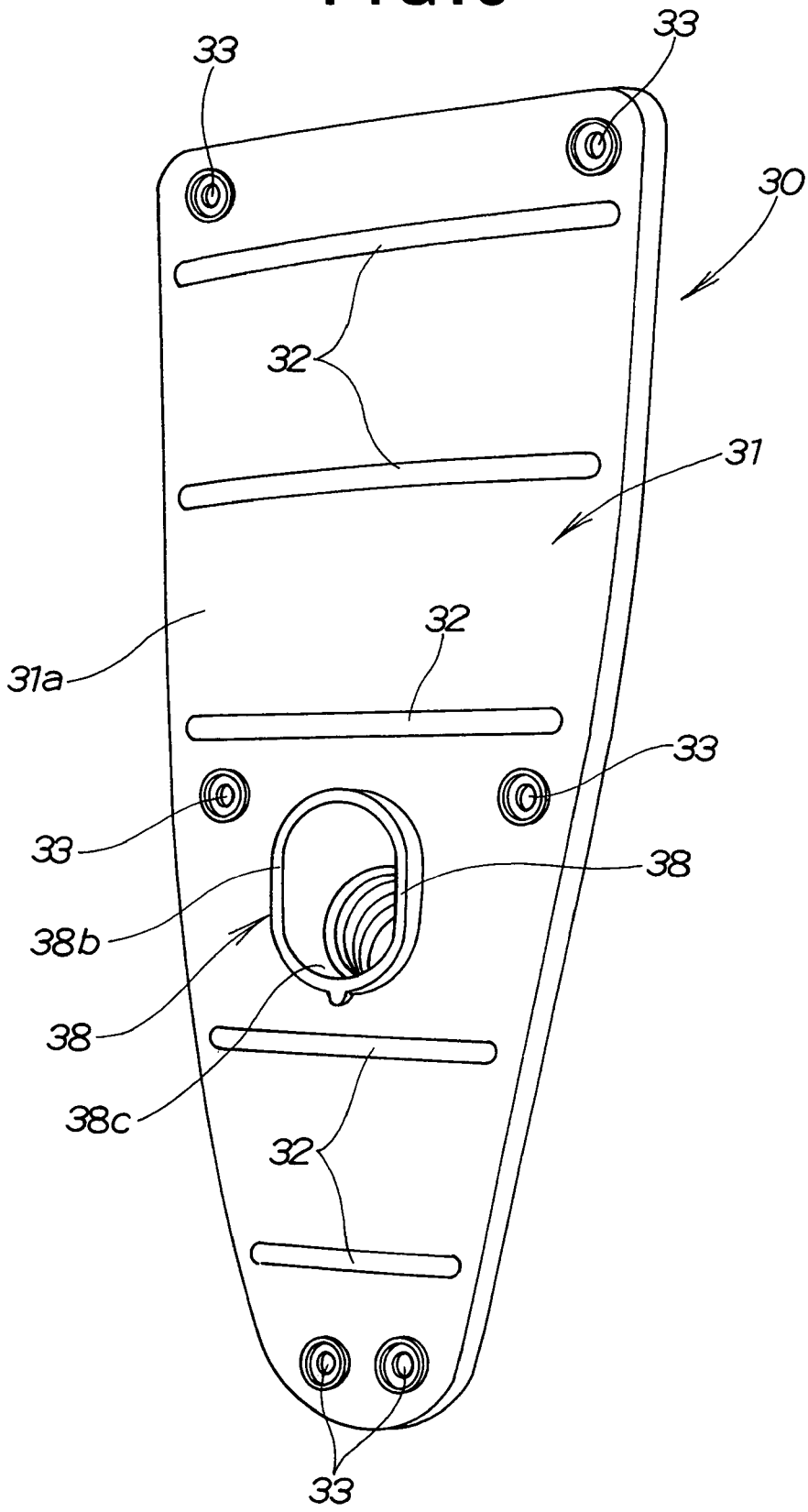
FIG. 3 is an enlarged perspective view showing a front side of the seal lid.

As shown in FIG. 3, the seal lid 30 has a plurality (five in the illustrated embodiment) of transverse grooves 32 formed in a front surface 31*a* of the plate-like lid body 31 for a purpose of improving the elasticity or bendability of the plate-like lid body 31 in a direction perpendicular to a longitudinal axis of the lid-body 31. The lid body 31 has plural attachment holes 33 corresponding in number and position to the first mounting holes 52*a* (FIG. 2) of the under cover 10. The attachment holes 33 receive respectively therein anchoring pins 41 (FIG. 2) to attach the seal lid 30 to the lid-mounting seat 51 of the under cover 10, as will be described later.

Figure 4:
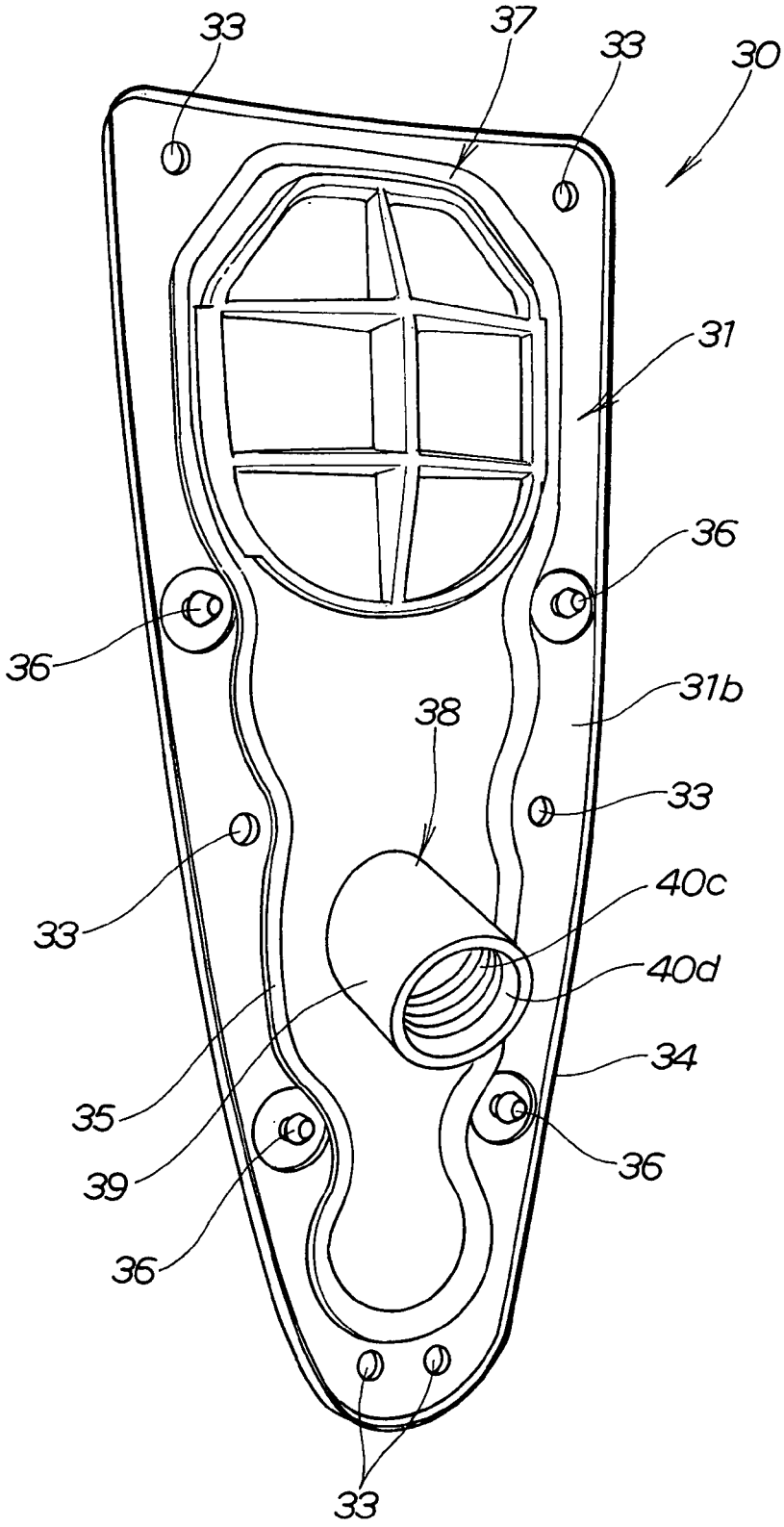
FIG. 4 is view similar to FIG. 3, but showing a rear side of the seal lid.
Figure 5:
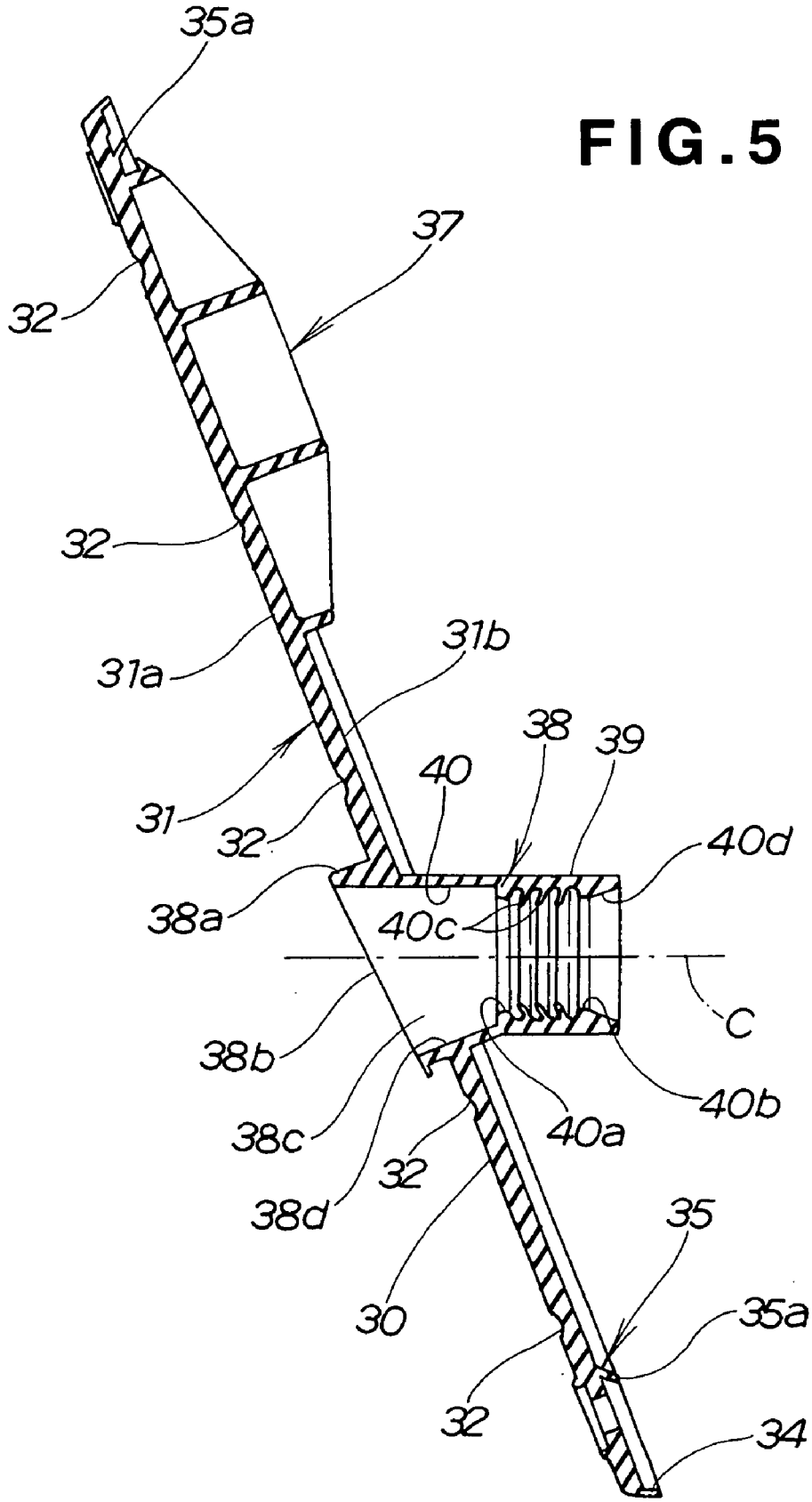
FIG. 5 is a vertical cross-sectional view of the seal lid.

As shown in FIG.4, the platelike lid body 31 has a flat rear surface 31*b* for intimate facetoface contact with a flat font surface of the lid-mounting seat 51. The lid-body 31 further has a peripheral seal lip 34 formed on the rear surface 31*b* continuously along a peripheral edge of the lid body 31, and an inner seal lip 35 also formed on the rear surface 31*b* and disposed inwardly of the of locking projections 36 and outwardly of a lattice-like seal block 37 and a tubular seal portion 38, and extends along the peripheral edge of the lid body 31 without interference with the individual locking projections 36. As shown in FIG. 5, the seal lips 34, 35 are inclined outwardly of the lid body 31. The inner seal lip 35 has a tip end 35*a*.

Referring back to FIGS. 2 and 4, the locking projections 36 are formed on the rear surface 31*b* of the lid body 31 and located at positions corresponding to the respective positions of the second mounting holes 52*b* (FIG. 2) of the under cover 10 for interlocking (snap-fit) engagement with the mounting holes 52*b*. The lattice-like seal block 37 is also formed on the rear surface 31*b* of the lid body 31 for sealing engagement with a peripheral edge of the upper opening 50*a* (FIG. 2). The lattice-like seal block 37 is self-supporting and has a sufficient degree of elasticity. The tubular seal portion 38 is located at a position generally corresponding to the position of the lower opening 50*b* (FIG. 2) of the under cover 10 so that when the seal lid 30 is attached to the under cover 10, the tubular portion 38 of the seal lid 30 and the outlet portion 20*a* of the exhaust release pipe 20 are concentric with each other. The locking projections 36, the lattice-like seal block 37 and the tubular seal portion 38 are formed integrally with the plate-like lid body 31. The locking projections 36 form a retaining portion of the seal lid 30 relative to the under cover 10.

As shown in FIG. 5, the tubular seal portion 38 is provided to extend across the thickness of the plate-like lid body 31 and projects from both the front surface 31*a* and the rear surface 31*b* of the lid body 31. The projecting length of the tubular seal portion 38 is larger at the rear surface side than at the front surface side. The tubular seal portion 38 has a central axis C extending in a horizontal plane, and the plate-like lid body 31 inclines rearward (leftward in FIG. 5) at an angle to the central axis C of the tubular seal portion so as to conform to an angle of inclination of the rear end portion (including the lid-mounting seat 51) of the under cover (FIG. 2) relative to the axis C of the outlet portion 20*a* (FIG. 2) of the exhaust release pipe 20.

Figure 6:
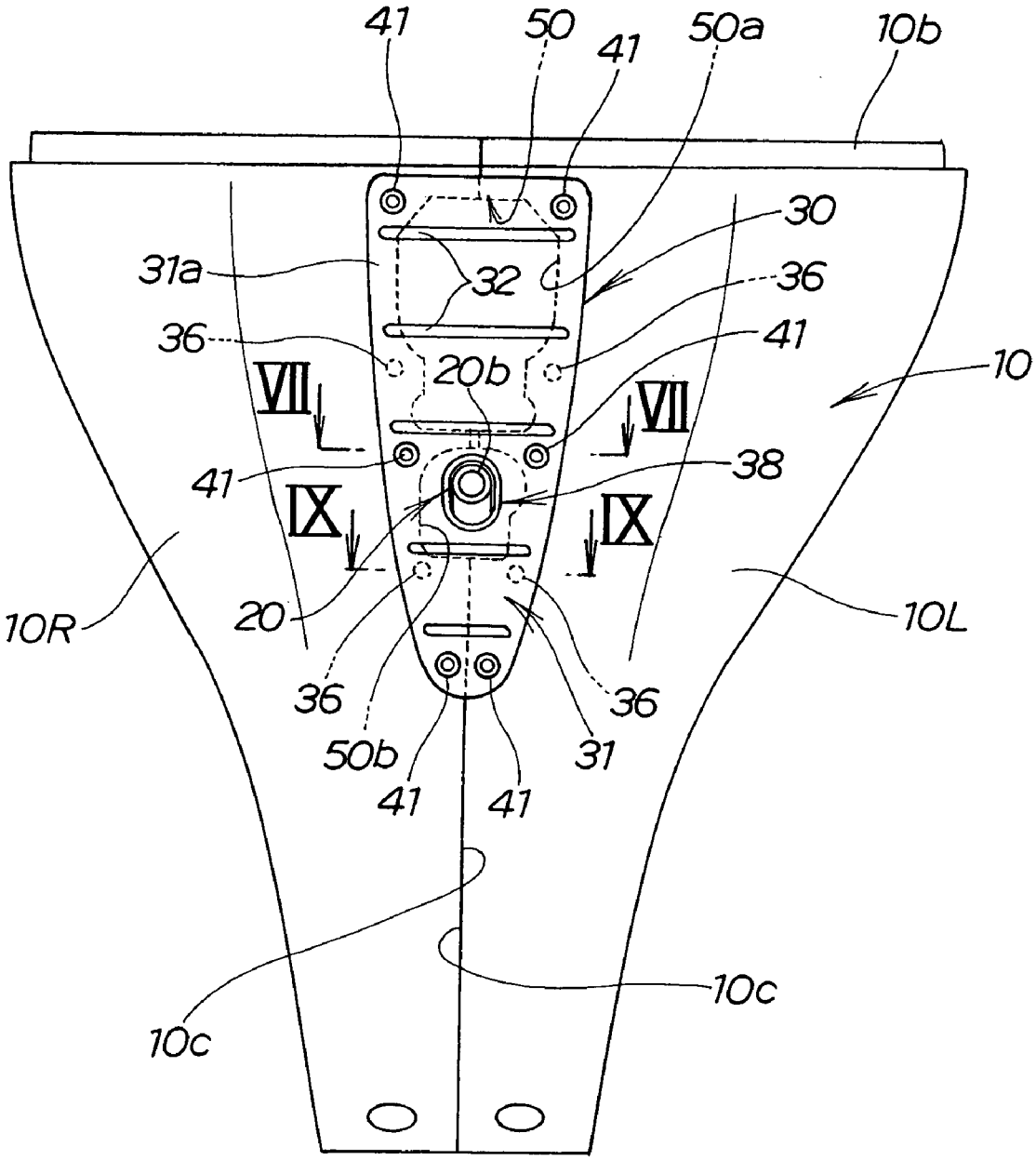
FIG. 6 is a rear view of the under cover with the seal lid attached thereto.

A front part 39 of the tubular seal portion 38, which projects from the rear surface 31*b* of the lid body 31 to a predetermined extent, is much longer than a rear part 38*a* of the tubular seal portion 38 which is projection from the front surface 31*a* of the lid body 31. The front part 39 thus forms a body of the tubular seal portion 38. The rear part 38*a* projects a short distance from the front surface 31*a* of the lid body 31 and has an end face 38*b* extending parallel to the front surface 31*a* of the lid body 31. This structure makes it difficult for the water to enter the tubular seal portion 38 from a rear end (outlet end) 38*c* thereof. A lower half 38*d* of the rear part 38*a* is sloped downward relative to the axis C of the tubular seal portion 38 so that the rear part 38*a* has a vertically elongated oblong shape, as shown in FIGS. 3 and 6. The downwardly sloped lower half 38*d* promotes smooth draining of the water from the tubular seal portion 38. It also facilitates easy removal of the tubular seal portion 38 from a mold when the seal lid 38 is produced by molding.

As shown in FIGS. 2 and 4, the front part or body 39 of the tubular seal portion 38 is circular in cross section and has substantially the same diameter throughout the length thereof. As shown in FIG. 5, the body 39 of the tubular seal portion 38 has two axially spaced annular retaining lugs 40*a* and 40*b* projecting from an inner circumferential surface 40 of the tubular seal portion 38. The first retaining lug 40*b* is located at a front end of the body 39 (also a front end of the tubular seal portion 38), and the second retaining lug 40*a* is located at an intermediate portion of the body 39 with an appropriate space defined between the first and second retaining lugs 40*b*, 40*a* in an axial direction of the body 39. The annular retaining lugs 40*a*, 40*b* have the same inside diameter and serve to retain an outside surface of the exhaust release pipe 20, as will be discussed later. Between the first and second retaining lugs 40*a* and 40*b*, there are provided a plurality (three in the illustrated embodiment) of annular seal lips 40*c* spaced at equal intervals in the axial direction of the body 39. The seal lips 40*c* have an inside diameter smaller than the inside diameter of the retaining lugs 40*a*, 40*b*. The seal lips 40*c* are inclined or tilted down toward the second retaining lug 40*a* i.e., toward the rear end of the tubular seal portion 38) for a purpose described below. The first retaining lug 40*a* has a beveled front end face 40*d* for facilitating smooth entry of the outlet portion 20*a* (FIG. 2) of the exhaust release pipe 20 into the tubular seal portion 38 when the tubular seal portion 38 is fitted over the outlet portion 20*a*.

As will be understood from FIG. 2, when the seal lid 30 of the foregoing construction is to be attached to the rear portion of the under cover 10, the rear surface 31*b* of the plate-like lid body 31 is held in confrontation with the lid-mounting seat 51 of the under cover 10 such the locking projections 36 are in general alignment with the second mounting holes 52*b* of the lid-mounting seat 51, the lattice-like seal block 37 is in general alignment with the upper opening 50*a* of the under cover 10, and the tubular seal portion 38 is in general alignment with the outlet portion 20*a* of the exhaust release pipe 20. The seal lid 30 is then forced against the rear end of the under cover 10 until the rear surface 31*b* of the lid body 31 is in intimate face to face contact with the flat front surface of the lid-mounting seat 51. During that time, the locking projections 36 come into locking engagement (or snap fit) with the second mounting holes 52*b*, the lattice-like seal block 37 comes into sealing engagement with a peripheral edge of the upper opening 50*a*, and the tubular seal portion 38 comes into fitting and sealing engagement with the outlet portion 20*a* of the exhaust release pipe 20 with a space defined between an outer circumferential surface of the body 39 and a peripheral edge of the lower opening 50*b*, as will be described in greater detail. Thereafter, the anchoring pins 41 are forced into the attachment holes 33 of the seal lid 30 until the seal lid 30 and the under cover 10 are connected together by the anchoring pins 41. The anchoring pins 41 form a retaining portion of the seal lid 30 relative to the under cover 10. With the seal lid 30 thus attached, the opening 50 of the under cover is fully closed by the seal lid 30 and the outlet portion 20*a* of the exhaust release pipe 20 is held watertight by the seal lips 40*c* (FIG. 5) of the tubular seal portion 38.

Figure 7:
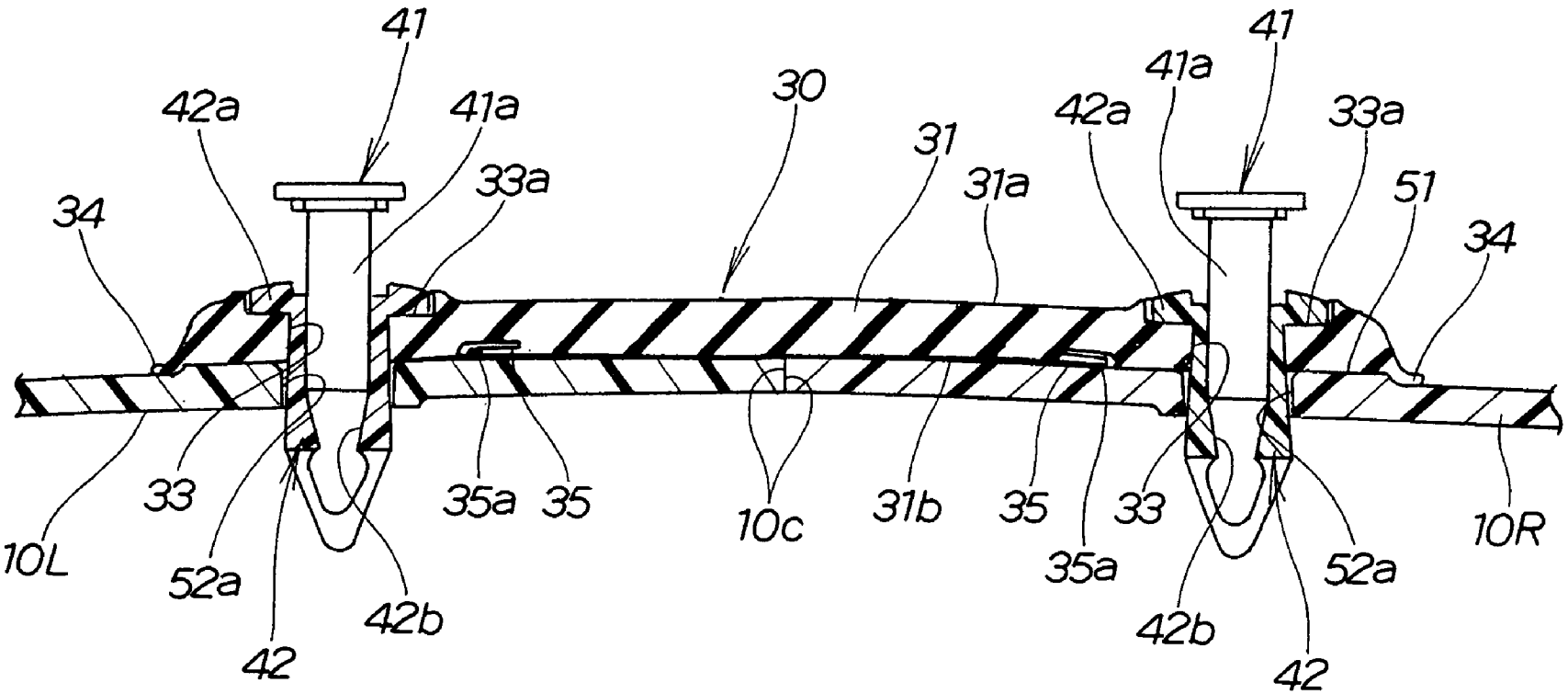
FIG. 7 is an enlarged cross-sectional view taken along line VII-VII of FIG. 6, showing anchoring pins disposed in an initial setting position.
Figure 8:
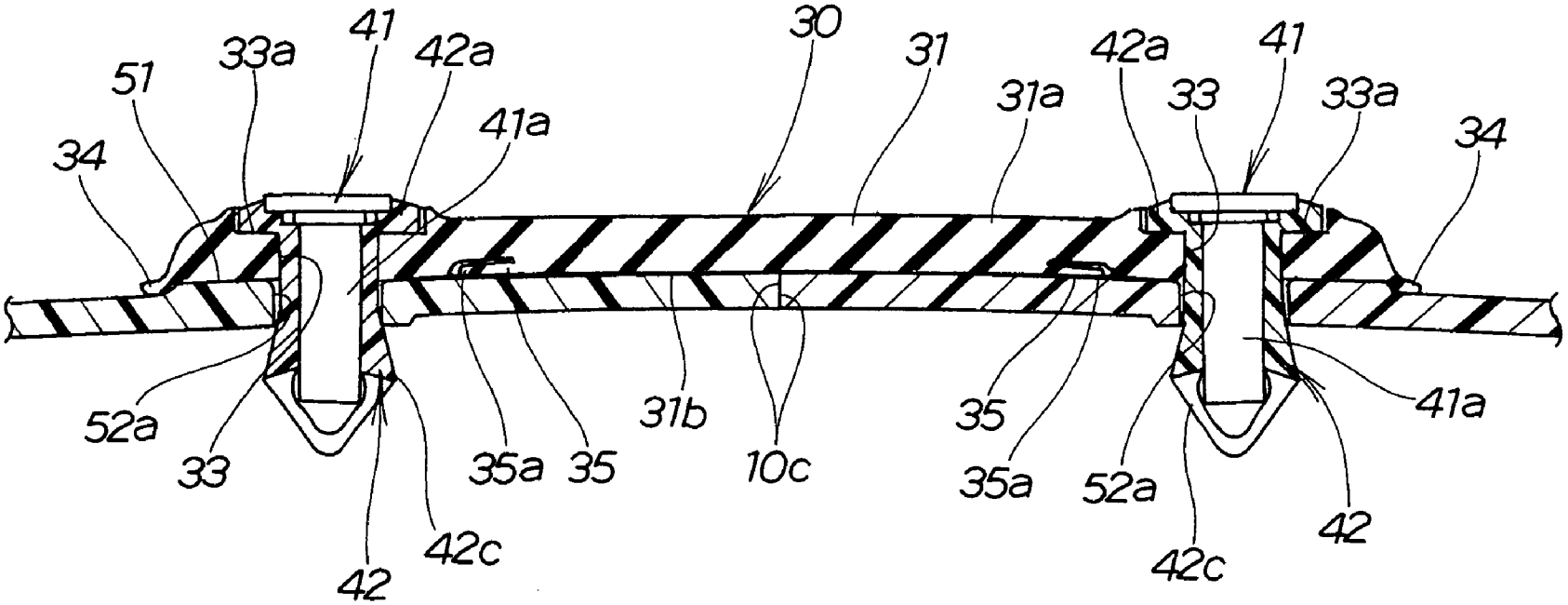
FIG. 8 is a view similar to FIG. 7, but showing the anchoring pins disposed in a final locking position.

FIGS. 7 and 8 illustrate the manner in which the seal lid 30 is attached to the under cover 10 by the anchoring pins 41.

The anchoring pins 41 are each composed of a headed pin body 41*a* and an expansion anchor sleeve 42 that are initially pre-assembled together in a condition shown in FIG. 7. The expansion anchor sleeve 42 is adapted to be inserted through one attachment hole 33 of the seal lid 30 and a corresponding first mounting hole 52*a* of the under cover 10. At one end (outer end) the expansion anchor sleeve 42 has a flange 42*a* for being received in a countersunk 33*a* of the attachment hole 33. An opposite end portion (inner end portion) of the expansion anchor sleeve 42 is split and tapered. In the pre-assembled condition of the anchoring pin 41, the pin body 41*a* is partly received in an axial hole 42*b* of the expansion anchor sleeve 42. The axial hole 42*b* is narrowed progressively or tapered over a longitudinal portion thereof extending from an intermediate portion toward the split and tapered inner end portion of the expansion anchor sleeve 42.

To attach the seal lid 30 to the under cover 10, the expansion anchor sleeve 42 of each anchoring pin 41 is inserted through one attachment hole 33 of the seal lid 30 and a corresponding first mounting hole 52*a* of the under cover 10 until the flange 42*a* of the expansion anchor sleeve 42 is seated on a bottom surface of the countersunk 33*a* of the attachment hole 33, with the pin body 41*a* being partly inserted in the axial hole 42*b* of the expansion anchor sleeve 42, as shown in FIG. 7. Then, the pin body 41*a* is forced into the axial hole 42*b* of the expansion anchor sleeve 42 until a head (not designated) of the pin body 41*a* is in abutment with the flange 42*a* of the expansion anchor sleeve 42. During that time, a tip end of the pin body 41*a* forcibly passes through the progressively narrowed or tapered portion of the axial hole 42*b* of the expansion anchor sleeve 42, thereby causing the split and tapered inner end portion of the expansion anchor sleeve 42 to expand in a radial outward direction as at 42*c* shown in FIG. 8. The radially expanded split and tapered inner end portion 42*c* of the expansion anchor sleeve 42 has an outside diameter sufficiently larger than an inside diameter of the mounting hole 52*a* so that the expansion anchor sleeve 42 is locked in position against removal from the mounting hole 52*a* of the under, cover 10 and the attachment hole 33 of the seal lid 30. A shank of the pin body 41*a* is retained inside the expansion anchor sleeve 42 due to the resiliency of the split tapered inner end portion 42*c* of the expansion anchor sleeve 42.

The seal lid 30 is thus attached to the under cover 10 by the anchoring pins 41, as shown in FIG. 8. In this condition, the peripheral seal lip 34 of the seal lid 30 elastically deforms to closely fit over a peripheral edge of the lid-mounting seat 51 to form a hermetic seal between the under cover 10 and seal lid 30. At the same time, the inner seal lip 35 of the seal lid 30 elastically deforms to lie flat on the front surface of the lid-mounting seat 51 with its tip end 35*a* directed outward of the seal lid 30. With the peripheral and inner seal lips 34, 35 thus arranged, the seal lid 30 has a double seal structure, which is highly resistant against the entry of water into the outboard motor. The seal lips 34, 35 each form a seal portion of the seal lid 30 relative to the under cover 10.

Figure 9:
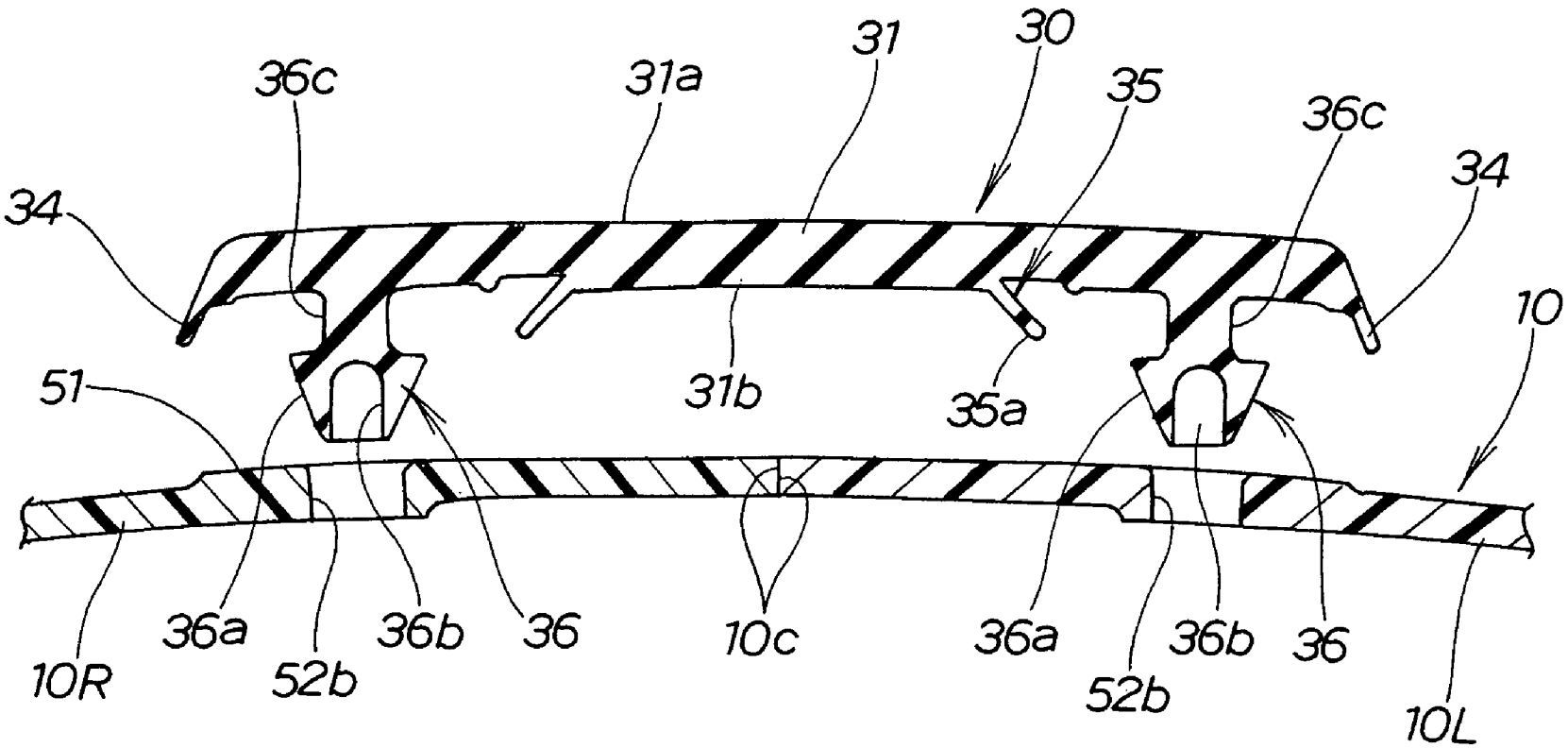
FIG. 9 is an enlarged cross-sectional view taken along line IX-IX of FIG. 6, showing the seal lid with locking prongs separated from mating mounting holes in the under cover.
Figure 10:
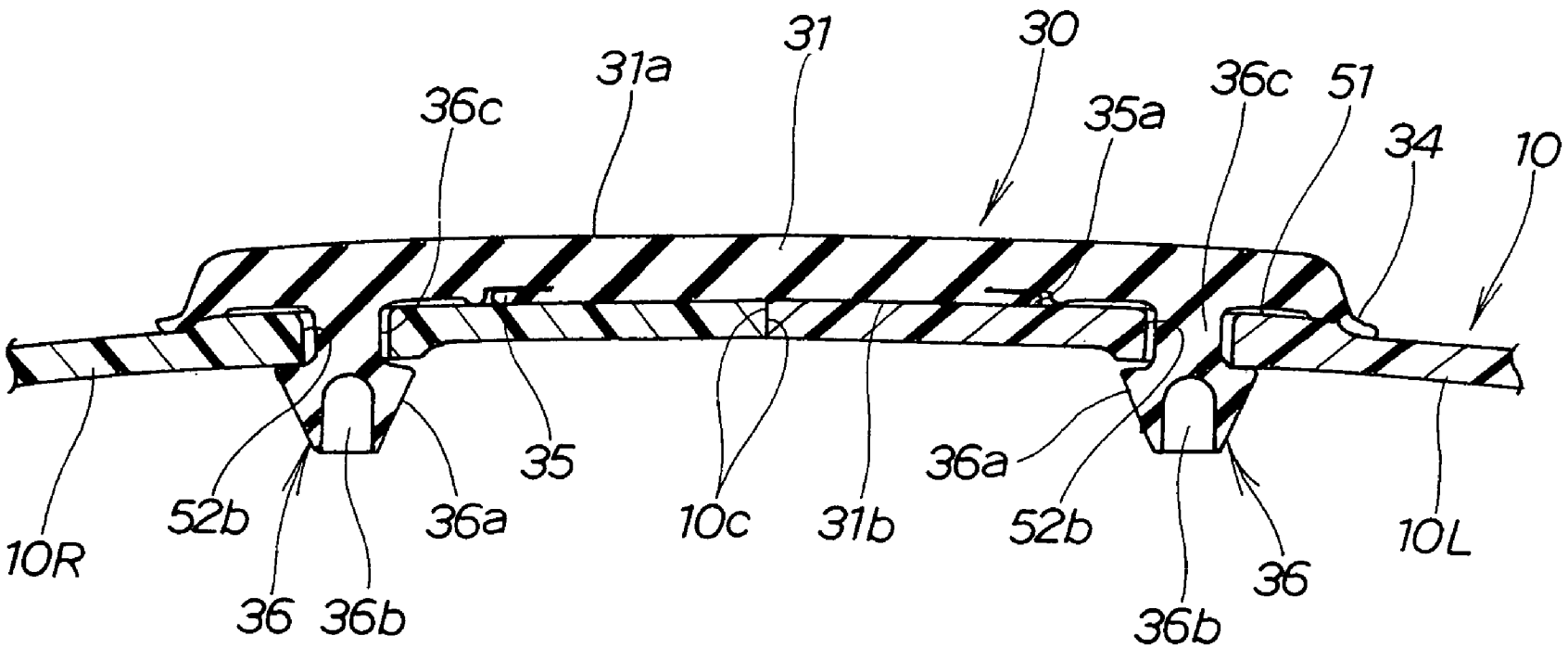
FIG. 10 is a view similar to FIG. 9, but showing the locking prongs fitted in the mounting holes to attach the seal lid to the under cover.

FIGS. 9 and 10 illustrate the manner in which the seal lid 30 is attached to the under cover 10 by the locking prongs or projections 36.

As shown in FIG. 9, each of the locking projections 36 has an enlarged head 36*a* and a reduced neck 36*b*. The enlarged head 36*a* is in the shape of a frustum and has a maximum outside diameter sufficiently larger than a diameter of the mounting hole 52*b*. The reduced neck 36*b* is in the shape of a cylinder having an outside diameter slightly smaller than the diameter of the mounting hole 52*b*. The enlarged head 36*a* has a recess 36*b* formed therein to facilitate elastic deformation of the enlarged head 36*a* in a radial inward direction thereof.

When the seal lid 30 is to be attached to the under cover 10, the seal lid 30 is held in confrontation with the lid-mounting seat 51 with the locking projections 36 being in general alignment with the respective mounting holes 52*b* of the lid-mounting seat 51, as shown in FIG. 9. The seal lid 30 is then forced or pressed against the lid-mounting seat 51 until the rear surface 31*b* of the lid body 31 comes in face-to-face contact the front surface of the lid-mounting seat 51, as shown in FIG. 10. During that time, the locking projections 36 are forced into the respective mounting holes 52*b* of the under cover 10. Stated more specifically, forced movement of the seal lid 30 toward the lid-mounting seat 51 causes each locking prong 36 to enter a corresponding one of the mounting holes 52*b* at a tip end of the enlarged head 36*a*. As the locking projection 36 further advances, the enlarged head 36*a* comes into contact with a peripheral wall of the mounting hole 52*b* and subsequently is forced to deform in a radially contracted configuration. In this instance, due to the presence of the recess 36*b*, the enlarged head 36*a* can readily deform in a radial inward direction, allowing the locking projection 36 to advance without undue resistance. A continued advancing movement of the locking prong 36 causes the enlarged head 36*a* to move past the mounting hole 52*b*, whereupon the radially contracted enlarged head 36*a* is allowed to spring back in a radial outward direction and restores its initial shape, as shown in FIG. 10. The locking projection 36 is thus interlocked (snap-fit) with the mounting hole 52*b*.

Figure 11:
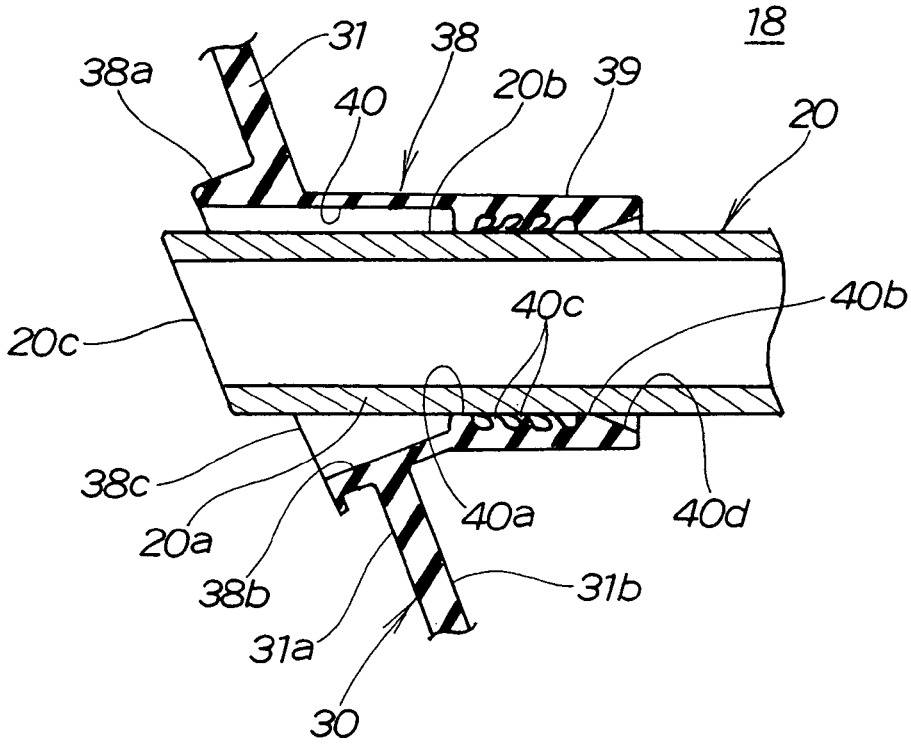
FIG. 11 is a cross-sectional view showing a tubular portion of the seal lid fitted around an exhaust release pipe to form a seal structure.

Referring next to FIGS. 5 and 11, description will be directed to a manner in which the outlet portion 20*a* of the exhaust release pipe 20 is sealed into a watertight structure by the tubular seal portion 38 of the seal lid 30.

As previously described, when the seal lid 30 is to be attached to the under cover 10, the tubular seal portion 38 is held in general alignment with the outlet portion 20*a* of the exhaust release pipe 20. When the plate-like lid body 31 of the seal lid 30 is forced against the lid-mounting seat 51 (FIG. 2) of the under cover 10 to fully close the opening 50, the tubular seal portion 38 of the seal lid 30 is fit over the outlet portion 20*a* of the exhaust release pipe 20, as shown in FIG. 11. During that time, the beveled front end face 40*d* of the first retaining lug 40*b* that is located at an inner end of the tubular seal portion 30 facilitates smooth and reliable entry of the outlet portion 20*a* of the exhaust release pipe 20 into the tubular seal portion 38 even when an offset of the outlet portion 20*a* of the exhaust release pipe 20 relative to the opening 50*b* of the under cover 10 is relatively large due to cumulative manufacturing and assembling tolerances of relevant parts of the outboard motor.

As the tubular seal portion 38 advances (or moves rightward in FIG. 11) into the engine room 18, the outlet portion 20*a* of the exhaust release pipe 20 moves deeper into the tubular seal portion 38 during which time the outlet portion 20*a* forcibly spreads the inside diameter of the first annular retaining lug 40*b* against the elasticity thereof, then forces the seal lips 40*c* to tilt down toward the second annular retaining lug 440*a* against the elasticity of the seal lips 40*c*, and subsequently forcibly spreads the inside diameter of the second annular retaining lug 40*a*. When the seal lid 30 is attached to the lid-mounting seat 51 (FIG. 2) of the under cover, the outlet portion 20*a* of the exhaust release pipe 20 slightly projects outward from the rear end face 38*b* of the tubular seal portion 38, as shown in FIG. 11. The exhaust release pipe 20 has a rear end face 20*c* cut to extend parallel to the rear end face 38*b* of the tubular seal portion 38.

In the condition shown in FIG. 11, the outlet portion 20*a* of the exhaust release pipe 20 is elastically supported or retained by the two axially spaced annular retaining lugs 40*a* and 40*b* so that the distance between an outer circumferential surface 20*b* of the exhaust release pipe 20 and the inner circumferential surface 40 of the tubular seal portion 38 is kept substantially constant throughout the length of the body 39 of the tubular seal portion 38. The annular retaining lugs 40*a*, 40*b* form a retaining portion of the seal lid 30 relative to the exhaust release pipe 20. The seal lips 40*c* disposed between the first and second retaining lugs 40*b*, 40*a* are in sealing contact with the outer circumferential surface 20*b* of the exhaust release pipe 20. Since at a portion of the exhaust release pipe 20 disposed between the retaining lugs 40*a*, 40*b*, the outer circumferential surface 20*b* of the exhaust release pipe 20 is substantially concentric with the inner circumferential surface 40 of the tubular seal portion 38, the seal lips 40*c* can engage the outer circumferential surface 20*b* of the exhaust release pipe 20 with uniform contact pressure throughout the circumference thereof. The seal lips 40*c* thus form a highly efficient and reliable seal structure relative to the exhaust release pipe 20. Furthermore, since the seal lips 40*c* are elastically deformed to tilt down toward the rear end of the tubular seal portion 38, it is possible to effectively prevent the water from entering the engine room 18 even when a negative pressure is created inside the engine room 18. The seal lips 40*c* form a seal portion of the seal lid 30 relative to the exhaust release pipe 20. The annular retaining lugs 40*a*, 40*b* also form a seal portion of the seal lid 30 relative to the exhaust release pipe 20.

In the case where the outlet portion 20*a* of the exhaust release pipe 20 and the opening 50 (more particularly, the opening 50*b*) are out of alignment with each other (or offset from each other) due to accumulated manufacturing and assembling tolerances, the tubular seal portion 38 (more properly, the inner part or body 39 of the tubular body 38) elastically deforms to bend about a proximal end thereof relative to the plate-like lid body 31 to thereby take up or absorb an offset between the outlet portion 20*a* of the exhaust release pipe 20 and the opening 50*b* of the under cover 10. Thus, the body 39 of the plastic tubular seal portion 38 forms an offset absorbing portion of the seal lid 30. In the embodiment shown in FIG. 11, the offset absorbing portion 39 is disposed interiorly of the under cover 10 (FIG. 2). The offset absorbing portion 39 when deformed does not affect the sealing performance of the seal lips 40*c*.

Figure 12:
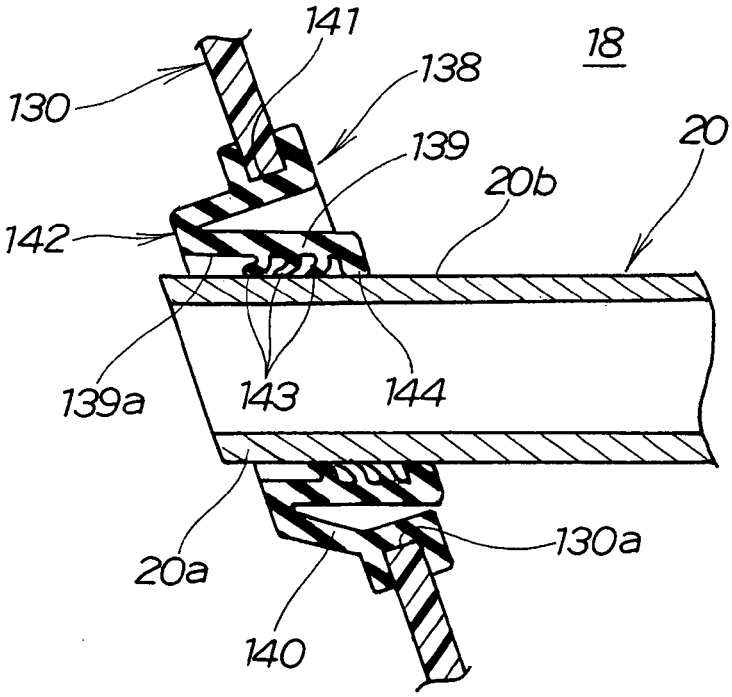
FIG. 12 is a view similar to FIG. 11, but showing a seal structure according to a modification of the present invention.

FIG. 12 shows a seal structure according to a modification of the present invention. An under cover (cover member) 130 of the outboard motor has an opening 130*a* from which an outlet portion 20*a* of an exhaust release pipe 20 projects outwardly. A seal means or member 138 is made of an elastic material such as rubber or soft synthetic resin. The seal member 138 generally has a double tube structure including an inner tube 139 fitted around an outer circumferential surface 20*b* of the exhaust release pipe 20, and an outer tube 140 retained on the under cover 130 via fitting engagement between a circumferential groove 141 formed at the other end (inner end) of the outer tube 140 and a peripheral edge of the opening 130*a* of the under cover 130. The inner tube 139 and the outer tube 140 are joined at one end (outer end) 142 thereof and extend at an angle to each other.

The inner tube 139 is concentric with the outlet portion 20*a* of the exhaust pipe 20 and has a plurality (three in the illustrated embodiment) of annular seal lips 143 and a single annular retaining lug 144 formed on an inner circumferential surface 139*a* of the inner tube 139. The retaining lug 144 is located at an inner end of the inner tube 139, and the seal lips 143 are disposed rearward of the retaining lug 144. More specifically, the sealing lips 143 are generally disposed in a plane of the cover member 130 including the opening 130*a*. The seal lips 143 are inclined toward an outer end of the seal member 138. The retaining lug 144 resiliently supports or retains the outlet portion 20*a* of the exhaust release pipe 20, and the seal lips 143 are in sealing contact with the outer circumferential surface 20*b* of the exhaust release pipe 20.

The retaining lug 144 forms a retaining portion of the seal member 138 relative to the outlet portion 20*a* of the exhaust pipe 20. The seal lips 143 form a seal portion of the seal member 138 relative to the exhaust release pipe 20. The circumferentially grooved inner end portion of the outer tube 140 forms both a retaining portion and a seal portion of the seal member 138 relative to the under cover 130. The seal portion of the seal member 138 relative to the under cover 130 is simple in construction as compared to that of the seal lid 30 according to the first embodiment shown in FIG. 11. The seal structure shown in FIG. 12 is can be manufactured at a relatively low cost and hence it is particularly useful when embodied in an application in which the seal member 138 is not subjected to an engine intake pressure. Stated more concretely, the opening 130*a* of the under cover 130 does open to the exhaust expansion chamber 17 (see FIG. 1) rather than to the engine room 18 as in the illustrated embodiment, and the exhaust release pipe 20 projects directly from the exhaust expansion chamber 17 through the opening 138*a* to the atmosphere outside the outboard motor.

The joint portion 142 between the inner end outer tubes 139, 149 allows the inner and outer tubes 139, 140 to elastically deform or flex with each other about the joint portion 142 to thereby take up or absorb an offset or eccentricity between the outlet portion 20*a* of the exhaust lease pipe 20 and the opening 130*a* of the under case 130 produced due to cumulative manufacturing and assembling tolerances of the relevant parts of the outboard motor. The elastic deformation of the seal member 138 does not affect sealing property of the seal member 138. Thus, the joint portion 142 forms an offset absorb portion of the seal member 138. In FIG. 12, the offset absorbing portion 142 is disposed exteriorly of the under cover 130.

Obviously, various minor changes and modifications of the present invention are possible in the light of the above teaching. It is therefore to be understood that within the scope of the appended claims the invention may be practiced otherwise than as specifically described.

What is claimed is:

1. An outboard motor comprising:

an engine;

a mount case on which the engine is mounted;

a cover structure that covers the engine;

an exhaust release pipe for releasing at least part of an exhaust gas from the engine into the air outside the outboard motor, the exhaust release pipe having an outlet portion projecting outward of the cover structure through an opening formed in the cover structure; and elastic seal means for creating a hermetic seal between the cover structure and the exhaust release pipe while closing the opening of the cover structure, the elastic seal means having a retaining portion engaged with the cover structure or the exhaust release pipe to retain the seal means on the cover structure or the exhaust release pipe, a first seal portion in sealing contact with the cover structure, a second seal portion in sealing contact with the exhaust release pipe, and an offset absorbing portion elastically deformable to absorb an offset between the exhaust release pipe and the opening of the cover structure without affecting the hermetic seal created between the cover structure and the exhaust release pipe, the elastic seal means comprising a seal member formed from an elastic material into a generally double tube structure having an inner tube fitted around the outlet portion of the exhaust release pipe and an outer tube retained on the cover structure, the inner tube and the outer tube being joined together at one end and extending at an angle relative to each other, a joint portion between the inner and outer tubes forming the offset absorbing portion of the seal means.

2. An outboard motor according to claim 1, wherein the offset absorbing portion formed by the joint portion between the inner and outer tubes is disposed exteriorly of the cover structure.

3. An outboard motor according to claim 1, wherein the retaining portion of the seal means comprises a circumferential groove formed at an opposite end of the outer tube and firmly fitted with a peripheral edge of the opening of the cover structure, and the second seal portion of the seal means comprises at least one annular seal lip formed on an inner circumferential surface of the inner tube and having an inside diameter smaller than an outside diameter of the outlet portion of the exhaust release pipe.

4. An outboard motor according to claim 3, wherein the seal lip is inclined toward an outlet end of the exhaust release pipe.

5. An outboard motor according to claim 3, wherein the seal member further comprises an annular retaining lug formed on the inner circumferential surface of the inner tube for elastically supporting the outlet portion of the exhaust release pipe, the annular retaining lug having an inside diameter smaller than the outside diameter of the outlet portion of the exhaust release pipe and larger than the inside diameter of the annular seal lip.

* * * * *